United States Patent [19]

Reid et al.

[11] 4,176,615

[45] Dec. 4, 1979

[54] MOORING ATTACHMENT FOR SINGLE POINT MOORING TERMINALS

[75] Inventors: William R. Reid, Ann Arbor, Mich.; John Vitale, Los Angeles, Calif.

[73] Assignee: Amtel, Inc., Providence, R.I.

[21] Appl. No.: 853,291

[22] Filed: Nov. 21, 1977

[51] Int. Cl.[2] ..... B63B 21/00

[52] U.S. Cl. ..... 114/230; 9/8 R

[58] Field of Search ..... 114/230, 215; 9/8 R, 9/8 P

[56] References Cited

U.S. PATENT DOCUMENTS

| | | | |
|---|---|---|---|
| T944,008 | 3/1976 | Schirtzinger | 9/8 P |
| 3,353,817 | 11/1967 | Bollinger | 114/215 |
| 3,442,245 | 5/1969 | Christians et al. | 114/230 |
| 3,783,816 | 1/1974 | de Chassy et al. | 9/8 P |
| 4,007,599 | 2/1977 | Brown | 9/8 P |

*Primary Examiner*—Jesus D. Sotelo

*Attorney, Agent, or Firm*—Freilich, Hornbaker, Wasserman, Rosen & Fernandez

[57] ABSTRACT

A mooring attachment for substantially permanently connecting a buoy and a storage-process vessel, wherein the mooring attachment is of smaller weight but as great a level of reliability as prior art attachments. The attachment includes a mooring arm having opposite ends coupled respectively to the buoy and vessel in pivot joints that hold them a distance apart but without restraining the vessel against yaw movement, and a pair of stop devices on either side of the mooring arm for preventing extreme yawing of the vessel. The stop devices can be formed by a pair of chains, each chain extending from an opposite side of the vessel to the buoy end of the arm, and each chain extending in a loose catenary when the vessel is in a center position but being pulled tight when the vessel yaws by a predetermined angle which is more than 10°, to prevent jackknifing of the vessel.

6 Claims, 3 Drawing Figures

MOORING ATTACHMENT FOR SINGLE POINT MOORING TERMINALS

BACKGROUND OF THE INVENTION

This invention relates to mooring attachments for signal point mooring terminals.

Oil handling installations located in bodies of water often utilize permanently attached vessels to store and/or process oil. Such vessels are typically permanently moored to a buoy that is held in a fixed location, and hoses extend between the buoy and the vessel to carry oil between them.

Prior art mooring attachments for holding the vessel to the buoy, have included rigid yokes, each yoke having a narrow end connected to the buoy and a split end connected to the vessel. The split, or bifurcated end permitted the vessel to move in pitch (its bow moving up and down) but prevented the vessel from yawing to thereby prevent it from jackknifing. U.S. Pat. No. 4,010,500 shows (in FIG. 4 thereof) a yoke of this type. Such a yoke is necessarily heavy to provide the bending resistance necessary to resist yawing of the vessel or sideward movement of the buoy. The large weight of the yoke, and the fact that considerable sideward forces are transmitted to the buoy when the vessel tends to yaw, are undesirable characteristics of the prior art mooring attachments.

SUMMARY OF THE INVENTION

In accordance with one embodiment of the present invention, a mooring attachment is provided for holding a vessel to a buoy, which is relatively light in weight and which minimizes forces transmitted to the buoy. The mooring attachment includes a mooring arm which acts like a column to resist tensile and compression forces, the arm having opposite ends connected to the buoy and vessel. The arm is pivotally connected to the vesssel so that it does not resist yawing of the vessel, and therefore can be constructed of moderate weight. In addition, a pair of stop means are utilized that are located on opposite sides of the vessel end to prevent the vessel from yawing by more than a predetermined angle from its central position. A study of the effects of various weather conditions on vessels, shows that in stormy weather or the like, the vessel tends to yaw only a limited amount, and that large yawing which could lead to jackknifing occurs only in moderate to calm conditions when stop means of only moderate strength are sufficient.

The stop means can be formed by a pair of hawsers, having buoy ends mounted on the buoy or the buoy end of the mooring arm, and opposite vessel ends mounted on the vessel at locations on opposite sides of the arm. The hawsers are long enough that neither one is pulled tight until the vessel yaws by a considerable amount, at which time one of the hawsers is pulled tight to prevent any further vessel yawing. A chain or other relatively unstretchable hawser may be utilized, in conjunction with a shock absorber that can elongate to prevent the application of large loads to a hawser when it is suddenly pulled taut.

The novel features of the invention are set forth with particularity in the appended claims. The invention will be best understood from the following description when read in conjunction with the accompanying drawings.

DESCRIPTION OF THE PREFERRED EMBODIMENT

Figure 3:
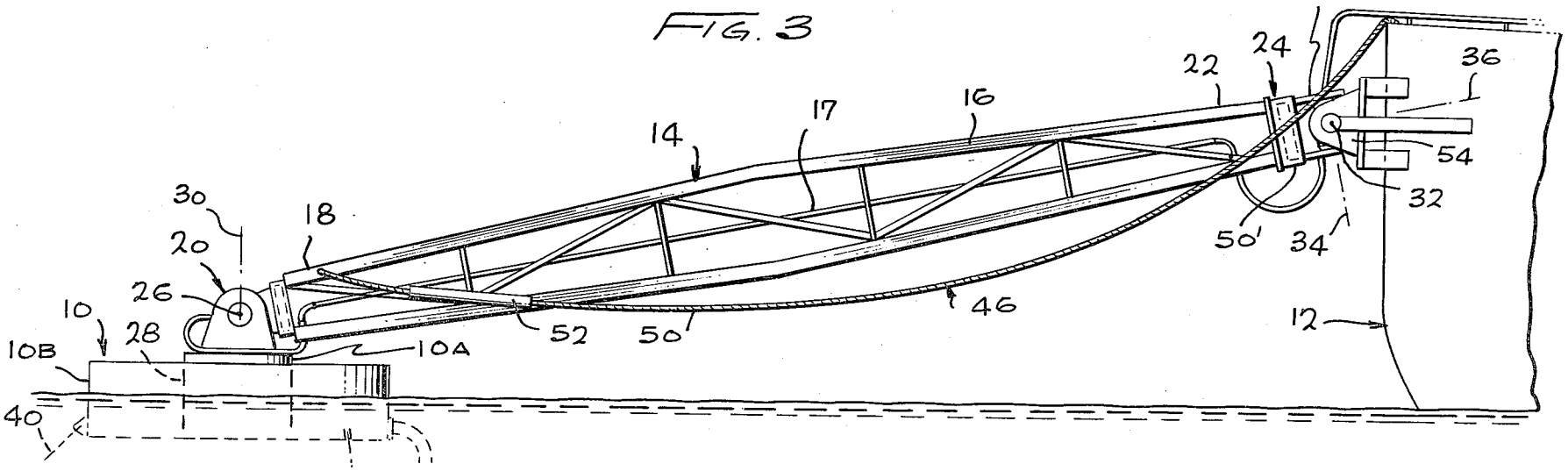
FIG. 3 is a side elevation view of the mooring installation of FIG. 1.

The figures illustrate a mooring installation which includes a buoy 10 that floats on a body of water and is held at a predetermined location thereon, a vessel 12, and a mooring attachment 14 that attaches the vessel to the buoy. The mooring attachment includes a main mooring arm 16 which is constructed to function as a column and as a tension member to resist collapse in compression or tension loading. The arm also supports a pipe 17 that connects the buoy and vessel. The arm 16 has an inner or buoy end 18 which is connected through a coupling 20 to the buoy, and has an opposite outer or vessel end 22 that is connected by another coupling 24 to the vessel. The first coupling 20 permits pivoting of the arm 16 with respect to the buoy 10 about a substantially horizontal axis 26. In addition, the portion 10A of the buoy to which the arm is connected, is coupled through a swivel unit 28 (FIG. 3) to the rest of the buoy 10B, to permit the buoy portion 10A and arm to pivot about the substantially vertical axis 30. The joint 24 which connects the vessel end of the arm to the vessel, permits the vessel to pivot about the three axes 32, 34 and 36 with respect to the arm 16. Thus, the vessel 12 is free to roll (pivot about the axis 36), pitch (pivot about the axis 32) and yaw (pivot about the axis 34).

The universal joint 24 which connects the mooring arm 16 to the vessel, minimizes the forces which the mooring arm 16 must resist. The mooring arm 16 must merely resist compression forces wherein the vessel tends to move closer to the buoy, and tension forces wherein the vessel tends to move away from the buoy. These forces are considerable since the buoy is prevented from drifting far from the predetermined position and therefore must also restrain the vessel. The particular buoy 10 is a calm type held in position by a group of chains 40 that extend in catenary loops to anchors at the sea bottom; another type of buoy, commonly referred to as the salm type, is mounted at the top of a tall structure whose lower end is pivotally mounted to a foundation at the sea bottom to also resist drifting of the buoy. The tension and compression forces, while considerable, are easily carried by a relatively light weight structure, as compared with bending moments that would be encountered by a prior art mooring attachment.

The freedom of the vessel 12 to roll, pitch, and yaw does no harm, unless the yaw is excessive. If the yaw becomes excessive, the vessel 12 assumes a "jackknifed" position wherein it can hit the buoy and cause damage to the vessel or buoy. Studies of the effects of varying sea conditions, show that yawing of the vessel is forceful only for limited degrees of yawing such as several degrees on either side of the central vessel yaw position shown in FIG. 2. This is because in rough seas, waves and winds acting on an elongated vessel tend to cause it to align itself with the arm. The possibility of jackknifing tends to occur under mild conditions of wind, sea, and currents, when the heading of the vessel changes because of shifting sea, wind or tides.

In accordance with the present invention, the mooring attachment 14 includes a pair of stop means 44, 46 which may be in the form of chains or other flexible tension members, extending from opposite sides of the vessel toward the buoy, and fastened to the buoy end of the mooring arm. The stop means permit the vessel 14 to yaw a moderate amount, as to allow the longitudinal axis 42 of the vessel to pivot by up to an angle A such as 20° on either side of a center vessel yaw position. In the center yaw position, the length of the mooring arm 16 is parallel to the longitudinal axis 42 of the vessel as seen in a plan view. However, when the vessel yaws by more than the predetermined angle, one of the chain stops such as 46 will be pulled tight to resist any further yawing of the vessel.

Figure 1:
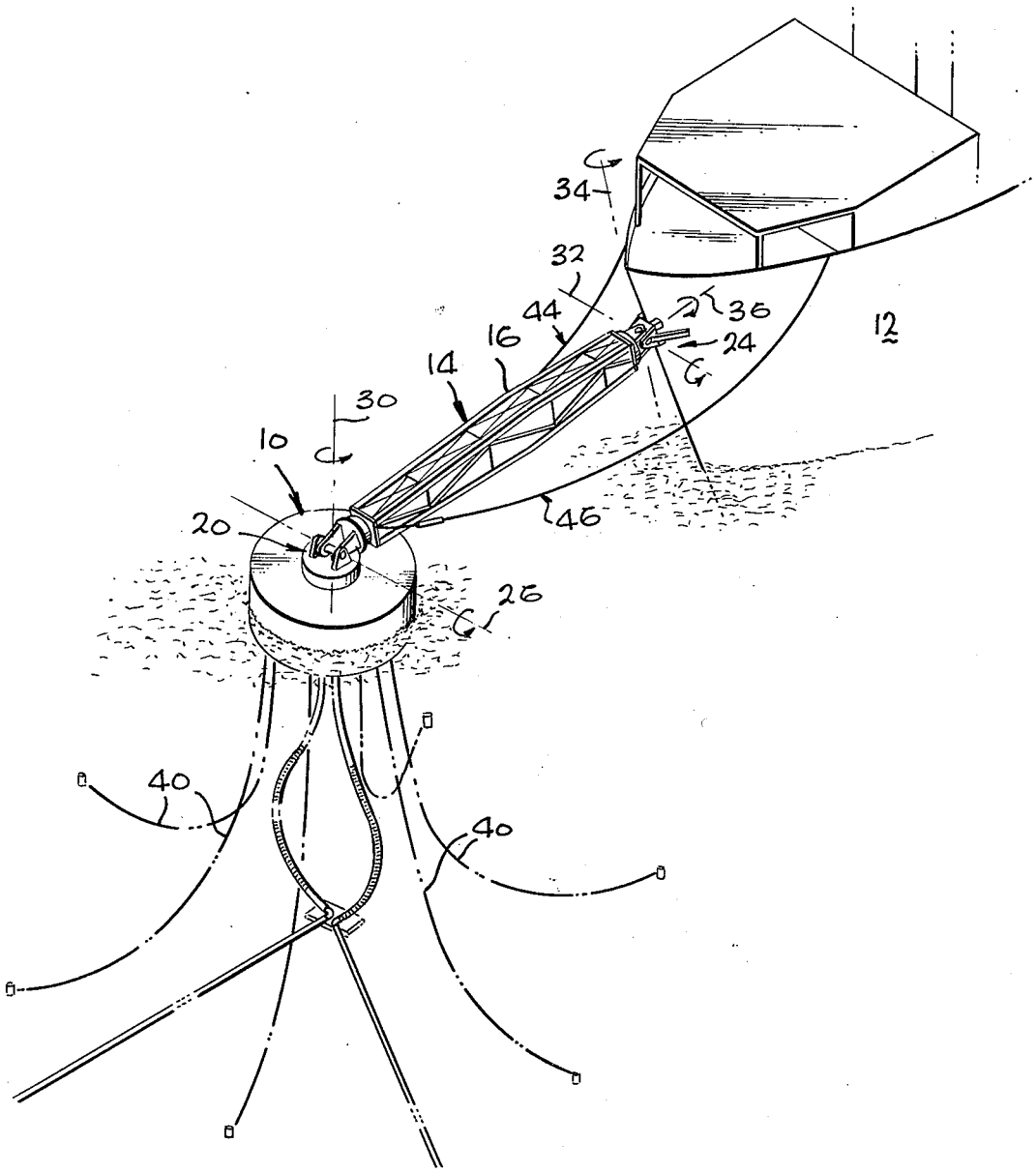
FIG. 1 is a perspective view of a mooring installation constructed in accordance with the present invention.
Figure 2:
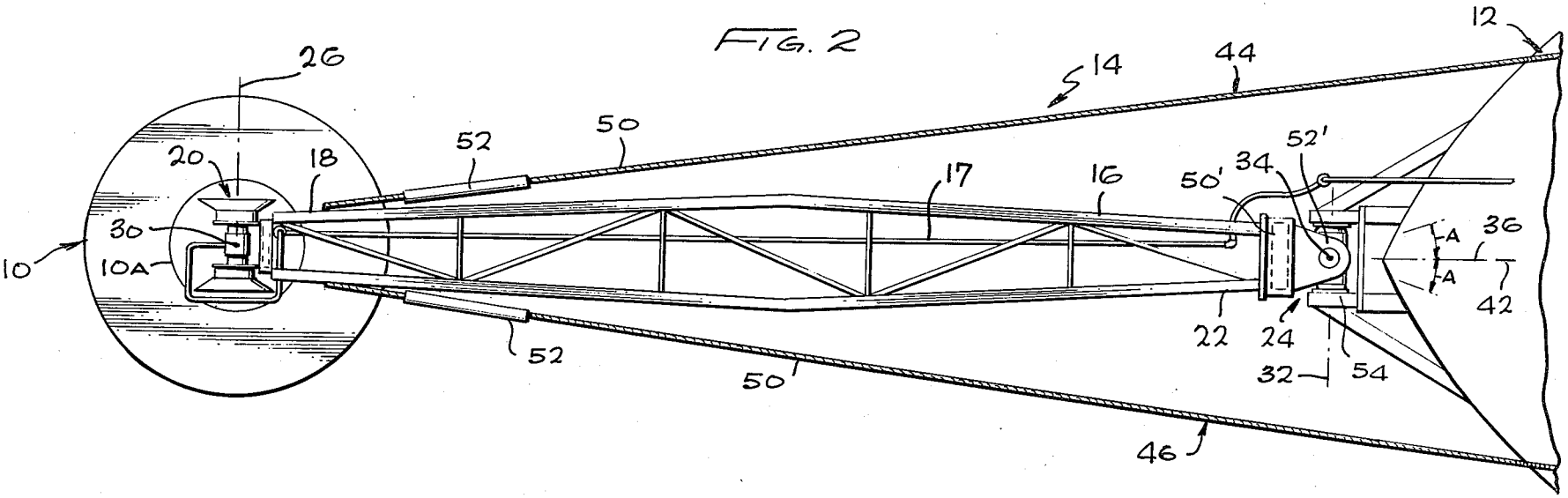
FIG. 2 is a plan view of the mooring installation of FIG. 1.

Each of the chain stops such as 46 hangs loosely when the vessel is in its center yaw position, as shown at 46 in FIG. 2. When the vessel 12 tilts so that the chain stop 46 is pulled tight, the chain stop must resist only tension forces. The mooring arm 16 will resist the resulting compression forces. Chains, cables, or other tension members that are flexible, can resist large tension forces even though they are of relatively small size and weight.

The fact that the chain or other tension members stops 44, 46 hang loosely while the vessel yaws several degrees on either side of its central position, results in these members 44, 46 normally not being subjected to large tension forces, and to the fact that the mooring arm 16 is normally not subjected to corresponding large compression forces. This is because severe weather conditions, when the largest forces can be applied, do not tend to cause large yawing movement. Large waves encountered in severe weather, tend to cause some yawing of the vessel. However, they tend to cause alignment of the vessel with the buoy, so that the waves do not tend to cause large yawing that could result in jackknifing. Under moderate to calm conditions when the vessel may tend to undergo large yawing, the tension stops 44, 46 and mooring arm 16 are subjected to only moderate tension and compression forces, respectively. Accordingly, the mooring attachment 14, including the mooring arm 16 and tension stops 44, 46 thereof, can be constructed from relatively light weight parts.

Each of the stop means 44, 46 can be constructed with a chain 50 and a shock absorber 52. The shock absorber 52 serves to prevent the sudden application of large tension forces to the chain 50, when it is pulled tight as the vessel is yawing, and when the momentum of the vessel could cause it to apply a large force to the chain if the chain had to suddenly stop it. Of course, it is also possible to utilize tension members of resilient material, so that a separate shock absorber is not needed.

Although the use of slack tension members in the stop means 44, 46 provides an efficient way of preventing excessive yawing, it is possible to utilize a variety of other stop means. For example, the arm 16 could carry a pair of bumpers extending from either side of its outer end 22, to engage either side of the vessel 22 when it yawed past a predetermined angle. Such an arrangement would, however, require the arm 16 to withstand substantial bending loads, so that a heavier arm would be required. However, even in that instance, the arm 16 could be of lighter construction than prior art yokes, since prior art yokes were constructed to prevent even a few degrees of yawing, rather than just preventing large yawing.

The choice of the angle A at which a stop means such as 46 begins to resist further yawing, depends largely upon the severity of the weather normally encountered in the location of the buoy. For areas of normally calm seas, an angle A of about 15 or 20 degrees may be utilized, although an angle as small as about 10° can be employed since forceful yawing is usually only a few degrees on either side of the center position. Where rough seas are encountered, a somewhat larger angle A such as 20 or 30 degrees may be utilized.

The coupling 24 which connects the vessel end of the mooring arm to the vessel, includes a roll swivel joint 50', a yaw swivel joint 52' and a pitch swivel joint 54. While the yaw and pitch joints 52', 54 can each be constructed with a shaft pivotally mounted at its ends to withstand only side loading, the roll joint 50' must withstand compression and tension loading which is a more severe type. To avoid the addition of side loading to the roll joint especially in view of the mooring arm extending at an incline, the roll joint 50' is positioned at the mooring arm end of the coupling 24, instead of the vessel end.

Thus, the invention provides a mooring attachment for connecting a vessel substantially permanently to a buoy, which is of relatively light weight, and yet which can maintain the connection through a wide range of weather conditions. This is accomplished by utilizing a substantially elongated column member, or mooring arm, having opposite ends connected to the buoy and vessel to permit the vessel to pivot about a substantially vertical axis so that the vessel can yaw, and by providing stop means for preventing yawing of the vessel by more than a predetermined angle which is normally more than 10° on either side of the center orientation of the vessel. Each of the stop means can include a flexible elongated tension member lying on opposite sides of the mooring arm, and with the tension members lying slack when the vessel is in the center orientation.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A mooring attachment for substantially permanently connecting a buoy and a vessel that has an end portion comprising:

a mooring arm that resists compression, having a first end pivotally coupled to said buoy and a second end pivotally coupled to an end portion of said vessel to permit said vessel to pivot about a largely vertical axis with respect to said arm, so that the vessel can yaw; and a pair of stop means disposed at opposite sides of said largely vertical axis for preventing yawing of said vessel by more than a predetermined angle which is more than 10° on either side of a center orientation of the vessel, said stop means constructed so they do not resist yawing of said vessel within 10° on either side of the center orientation of the vessel, whereby to avoid loading of the stop means during small vessel yawing.

2. The mooring attachment described in claim 1 including:

a coupling that couples the second end of the mooring arm to the vessel, including a roll joint, a yaw joint, and a pitch joint that respectively permit movement of the vessel in roll, yaw, and pitch with respect to the mooring arm;

said yaw and pitch joints located between said roll joint and said vessel.

3. A mooring attachment for attaching a vessel to a buoy, including;

a main mooring arm which is resistant to both collapse and elongation, said arm having a first end coupled to said buoy and a second end coupled to said vessel, so that the arm prevents the coupled vessel location from both approaching and retreating from the buoy; and a pair of chain means, each having a first end mounted at a substantially fixed location with respect to said buoy and a second end connected to said vessel, said second ends of said chain means lying on opposite sides of said second end of said mooring arm, and said chain means each being slack when the vessel is in a central orientation.

4. Apparatus for substantially permanently holding an elongated vessel to a buoy that has a rotatable portion that can rotate about a substantially vertical axis and another portion held against unlimited rotation, comprising:

an arm which resists compression and elongation and having a buoy end and a vessel end;

a first coupling pivotally connecting said buoy end of said arm to said rotatable portion of said buoy, to permit said arm to pivot about a substantially horizontal axis relative to the buoy;

a second coupling pivotally connecting said vessel end of said arm to an end of said vessel, to permit said vessel end to pivot in pitch, roll and yaw with respect to the arm; and a pair of tension members which cannot resist substantial compression but which can greatly resist tension forces, each extending from near the buoy end of the arm to a different side of the vessel, each tension member being slack when the vessel is in line with the buoy but a corresponding tension member being pulled tight when the vessel pivots by a predetermined angle from said in line position.

5. A mooring attachment for substantially permanently connecting a buoy and a vessel that has an end portion comprising:

a mooring arm that resists compression, having a first end pivotally coupled to said buoy and a second end pivotally coupled to an end portion of said vessel to permit said vessel to pivot about a largely vertical axis with respect to said arm, so that the vessel can yaw; and a pair of stop means disposed at opposite sides of said largely vertical axis for preventing yawing of said vessel by more than a predetermined angle which is more than 10° on either side of a center orientation of the vessel;

said stop means including flexible elongated tension members extending from laterally spaced locations on said vessel towards said buoy, said tension members lying slack when said vessel is in said center orientation.

6. The mooring attachment described in claim 5 wherein:

each of said tension members includes a substantially unstretchable portion extending along most of the length of the member, and a shock absorber means connected in series with said unstretchable portion to permit resilient elongation of the tension member.

* * * * *